US006368003B1

(12) United States Patent
Sorrell

(10) Patent No.: US 6,368,003 B1
(45) Date of Patent: Apr. 9, 2002

(54) HAND-HELD BODY WASHING DEVICE

(76) Inventor: Roger Lynn Sorrell, 9804 Southview Ct., Raleigh, NC (US) 27604

( * ) Notice: Subject to any disclaimer, the term of this patent is extended or adjusted under 35 U.S.C. 154(b) by 0 days.

(21) Appl. No.: 09/800,950

(22) Filed: Mar. 7, 2001

(51) Int. Cl.[7] ..... B43M 11/06

(52) U.S. Cl. ..... 401/185; 401/201; 401/183; 15/210.1

(58) Field of Search ..... 401/201, 185, 401/184, 183, 265, 266, 261; 132/290; 115/104.92, 209.1, 210.1, 229.11, 229.12; 139/6; 222/187, 206, 207, 212, 213, 215

(56) References Cited

U.S. PATENT DOCUMENTS

| | | | | |
|---|---|---|---|---|
| 1,748,406 A | | 2/1930 | Blair | |
| 1,909,966 A | | 5/1933 | Jones | |
| 2,588,773 A | | 3/1952 | Smith | |
| D203,658 S | | 2/1966 | Schoenfield et al. | |
| 3,488,126 A | | 1/1970 | Avallone | |
| 3,617,139 A | | 11/1971 | Ross | |
| 3,775,014 A | | 11/1973 | Rosborne | |
| 4,457,640 A | | 7/1984 | Anderson | |
| 4,457,643 A | | 7/1984 | Caniglia | |
| 4,665,580 A | | 5/1987 | Morris | |
| 4,969,225 A | | 11/1990 | Schubert | |
| D367,137 S | | 2/1996 | Pollak et al. | |
| 5,517,705 A | | 5/1996 | Jackson | |
| D392,433 S | | 3/1998 | Norris | |
| 5,944,032 A | * | 8/1999 | Masterson | 132/290 |
| 6,039,491 A | * | 3/2000 | Badillo | 401/185 |
| 6,161,246 A | * | 12/2000 | Trachtenberg | 15/229.13 |
| D452,349 S | * | 12/2001 | Badillo | D28/63 |

* cited by examiner

*Primary Examiner*—David J. Walczak
(74) *Attorney, Agent, or Firm*—Coats & Bennett, P.L.L.C.

(57) ABSTRACT

A hand-held washing device that contains soap within the interior. The device is constructed of an elongated material bound together in a plurality of pleats. The soap may be in a variety of forms including a bar and a fluid dispenser comprising a nozzle and a reservoir. A cinch extends around and holds the pleats together.

4 Claims, 5 Drawing Sheets

HAND-HELD BODY WASHING DEVICE

BACKGROUND OF THE INVENTION

The present invention is directed to a hand-held washing device and, more particularly, a washing device constructed of elongated material folded into a plurality of pleats containing either a bar of soap or a fluid dispenser containing liquid soap.

A variety of hand-held washing devices are available such as scrub brushes, sponges, and the like. These require that soap be separately applied prior to using the device. After the soap is applied, the device is used for scrubbing or otherwise distributing the soap along a user's body. This is inconvenient as it either requires the user to hold the soap in one hand and the device in the other, or requires the user to repeatedly pick up and set down the device and soap as needed.

Some designs feature integrated soap contained within the device. However, these designs are difficult for the user as the soap either cannot be refilled or is difficult to replenish once depleted. Designs that cannot be refilled are obviously not effective after they are extinguished and must be replaced by a new device. Designs that are difficult to refill may not be favored by users. Refilling of these devices is often difficult because the soap is located in the device interior that is difficult to access. Conversely, some designs feature the soap on the device exterior which is easy to access, but may result in the soap repeated falling out of the device, or scratching the user during use such as when the soap is contained within a fluid dispenser.

The device should further be designed such that the soap is not damaged or discharged when not in use. By way of example, the bar of soap stored within a wet device will become soft and fall apart during a subsequent washing. Fluid dispensers should be able to contain the washing liquid such that it does not leak or discharge when the device is not in use.

It is also advantageous that the device be aesthetically pleasing. Washrooms and bathrooms are often fanciful decorated and users do not want to put an unattractive object within the environment. It is advantageous if the device itself can further add to the aesthetic qualities of the room.

SUMMARY OF THE INVENTION

The present invention is directed to a hand-held washing device having soap contained therein. The device is constructed of an elongated mesh material that is secured together to form a plurality of pleats. A cinch extends around and maintains the pleats together.

In one embodiment, a soap pocket sized to contain a bar of soap is positioned within the pleats. The soap pockets may be constructed of two layers of material connected together to form the pocket. An opening in the pocket allows the user to insert a new soap bar as needed.

A second embodiment features a fluid dispenser disposed within the pleats. The fluid dispenser includes a nozzle that is secured within the cinch. A neck extends outward to which a soap reservoir is attached. In one embodiment, the reservoir is a flexible bulb that when squeezed by the user, propels the liquid within through the nozzle and out of an outlet to be distributed onto the pleats.

Placing the soap at the interior of the device allows the user to hold a single item when bathing. The user is not required to hold both the soap and the device. This is more comfortable and convenient. Likewise, the soap is easy to access and replace. The soap pocket includes an opening for removing and/or replacing the soap bar and the fluid dispenser includes a removable reservoir that may be refilled with liquid soap as needed.

DETAILED DESCRIPTION OF THE INVENTION

Figure 1:
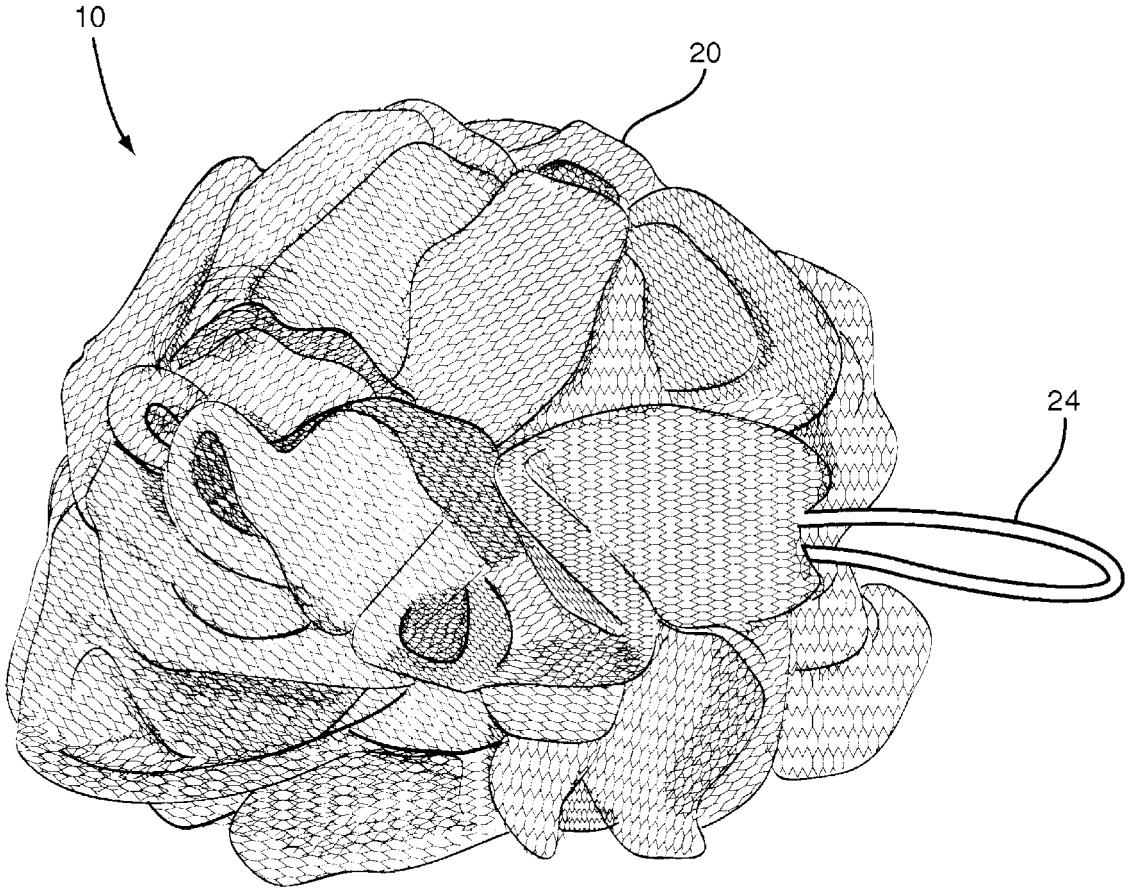
FIG. 1 is a perspective view of one embodiment of the present invention.

The present invention is a hand-held washing device, illustrated generally as 10 in FIG. 1, that contains soap within the interior. The device 10 is constructed of an elongated mesh material 20 gathered together to form a plurality of pleats. A cinch 30 extends around and holds the pleats together. The soap may be in a variety of forms including a bar 42 and a fluid dispenser 44 comprising a nozzle 46 and a reservoir 48.

The washing device 10 is preferably constructed from an elongated mesh material 20. Mesh provides some abrasive characteristics when the user rubs the device 10 against the skin to aid in the washing process. Mesh may also dry quicker than a woven or knit material to prevent bacteria from forming within the material between uses. Additionally, mesh allows air to move through the device to dry the soap bar 42 contained within the embodiment illustrated in FIG. 2. The mesh may further be non-absorbent. In one embodiment, the mesh is constructed of tubular nylon, but other natural or synthetic materials may be used.

In another embodiment, washing device 10 is constructed of a plurality of different elongated materials. The materials are folded together forming pleats having either one or both materials and being secured together by the cinch 30. The different materials may allow for different aesthetic appearances, such as each material being of a different color. Each material may further have a different texture to aid in the washing process and increase the comfort and feel to the user.

Figure 2:
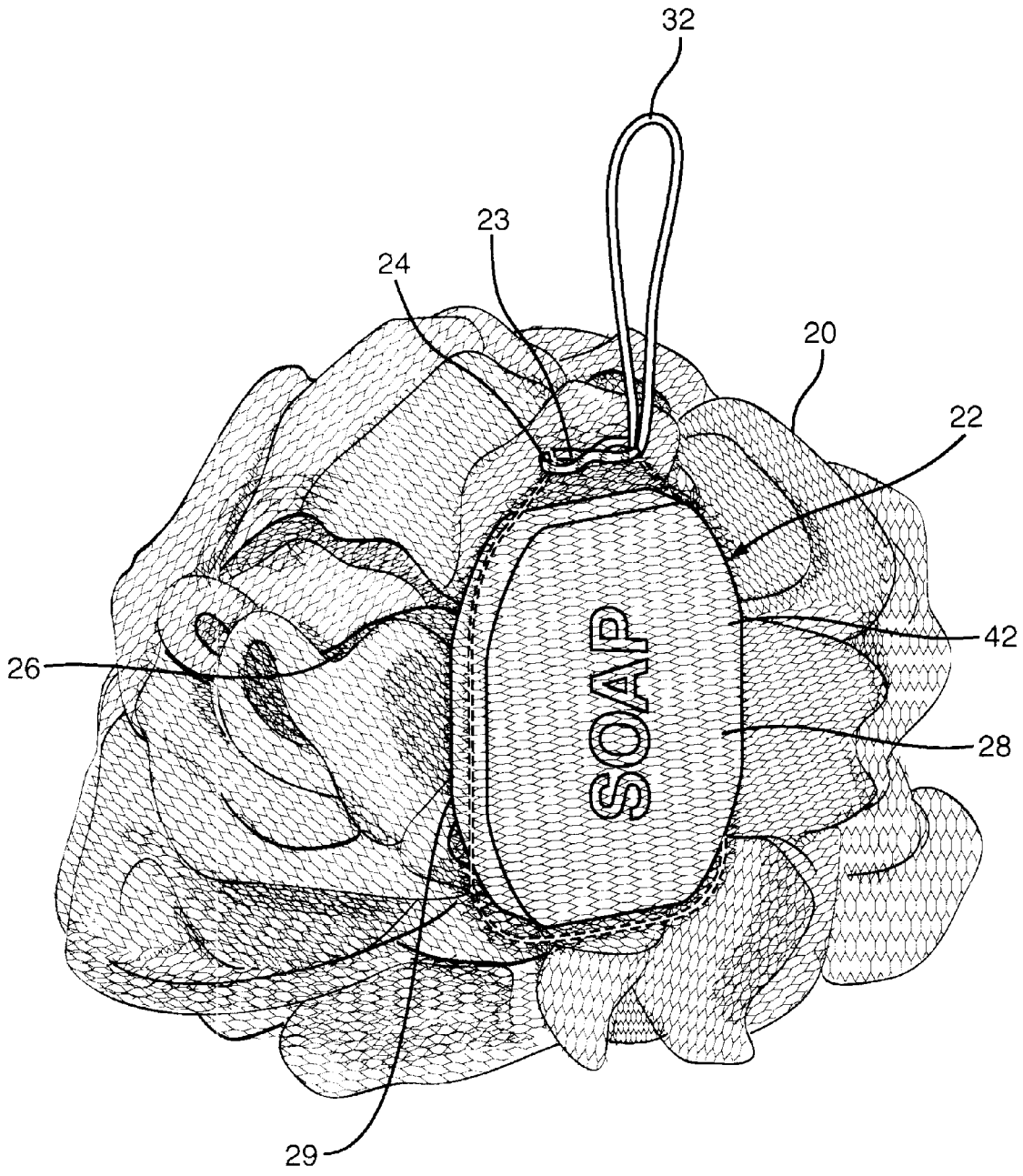
FIG. 2 is a cut-away perspective view of one embodiment of the device illustrating a bar of soap contained within a soap pocket.

FIG. 2 illustrates an embodiment with a bar of soap 42 positioned within the pleats. A soap pocket 22 is formed to contain the soap bar 42 within the interior of the pleats. An opening 23 is positioned within the soap pocket 22 for inserting the bar 42. A drawstring 24 may be positioned for closing and securing the opening 23. In the embodiment illustrated in FIG. 2, drawstring 24 is sized to extend beyond the pleats to form a handle 32 for the user. Handle 32 may be an extension of the drawstring 24, an extension of the cinch 30, or may be a separate piece. In one embodiment, seams 26 form the soap pocket 22 and contain the soap 42.

Soap pocket 22 may be formed from the same piece of material as the washing device 10, or may be a separate material positioned within the interior of the device 10.

Figure 3A:
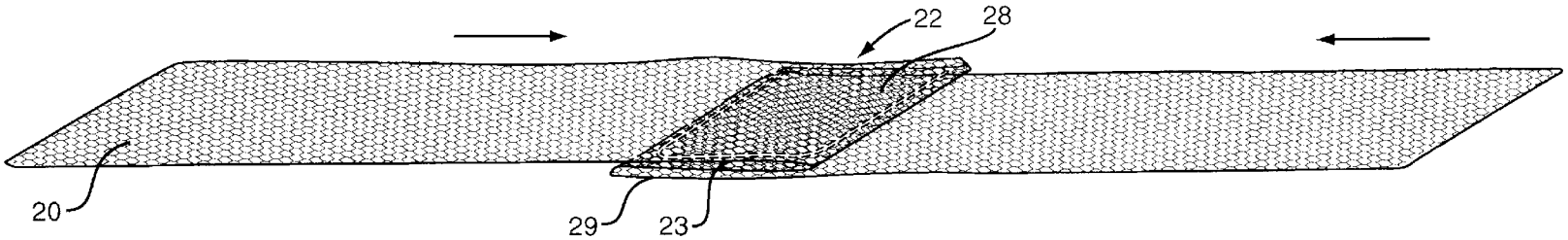
FIG. 3A is a perspective view illustrating the step of forming the soap pocket within a central area of the elongated material.
Figure 3B:
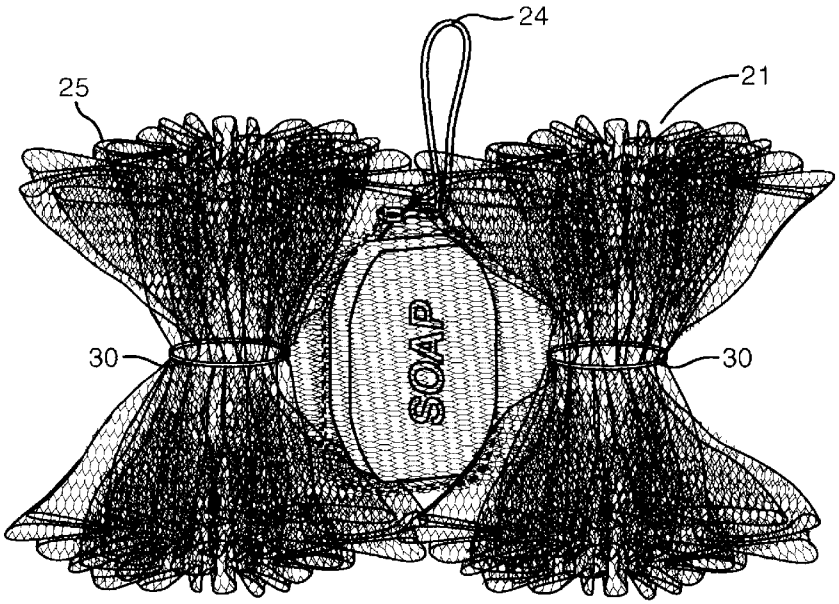
FIG. 3B is a perspective view illustrating pleats bundled on each side of the soap pocket.

FIGS. 3A and 3B illustrate a method of making the washing device 10. The elongated material 20 may be folded in half, or may be a single layer with the soap pocket formed within a central section. In the embodiment illustrated in FIG. 3A, the soap pocket 22 is created by folding the material 20 forming front 28 and back 29 panels. A seam 26 may connect the panels and include an opening 23 through which the bar of soap 42 is inserted. The material 20 on each side of the soap pocket 22 is then gathered together in the direction indicated by the arrows forming a plurality of pleats 21, 25 as illustrated in FIG. 3B. Cinches 30 secure the pleat sections 21, 25 together. The sections 21, 25 are then attached to the soap pocket 22 in a manner in which the opening 23 is positioned within the pleats but accessible by the user. A drawstring 24 may be inserted around the opening 23 to selectively open and close the soap pocket 22. Drawstring 24 may extend to provide a handle for the user. The pleats 21, 25 then fall around the cinches 30 and obscure the soap pocket 22 such as illustrated in FIG. 1.

Figure 4:
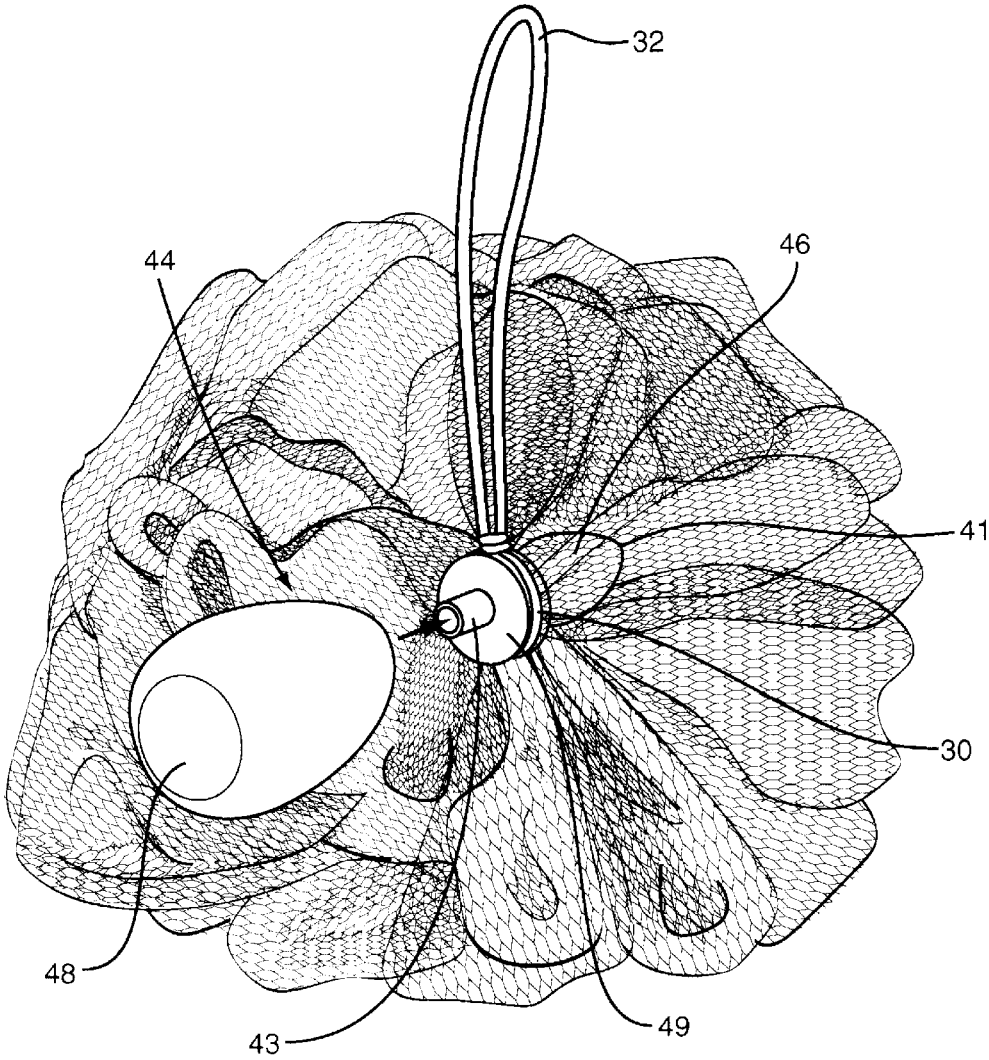
FIG. 4 is a cut-away perspective view of another embodiment having a fluid dispenser contained within the pleats.

FIG. 4 illustrates another embodiment in which a fluid dispenser 44 is positioned within the pleats for holding and dispensing a liquid, such as soap, perfume, and the like. The fluid dispenser 44 comprises a nozzle 46 and a reservoir 48. The nozzle 46 includes an outlet 41 having an aperture through which the liquid is emitted and a neck 43. In one embodiment, reservoir 48 is a flexible bulb that is squeezed to force the liquid out through the outlet 41. An opening (not illustrated) within the reservoir 48 is sized to mate with the neck 43. When the liquid is extinguished, the user separates the reservoir 48 from the nozzle, refills it with liquid, and then reattaches the reservoir 48 to the neck 43.

A cinch 30 extends around and holds together the pleats and nozzle 46. Cinch 30 may have a variety of lengths depending upon the size of the pleats and nozzle 46. In one embodiment, cinch 30 comprises a string that extends around and tied to contain the pleats and nozzle 46. In another embodiment, cinch 30 is an elastic band that is stretched to extend around the pleats and nozzle 46 and then released to contain the pleats. The pleats conceal the cinch 30 and nozzle such that it is not visible to a user as illustrated in FIG. 1. Additionally, cinch 30 and nozzle 46 do not directly contact the user when bathing with the device 10 as it may be abrasive or otherwise uncomfortable to the user. Nozzle 46 may further include flanges 49 for maintaining the cinch 30.

Figure 5:
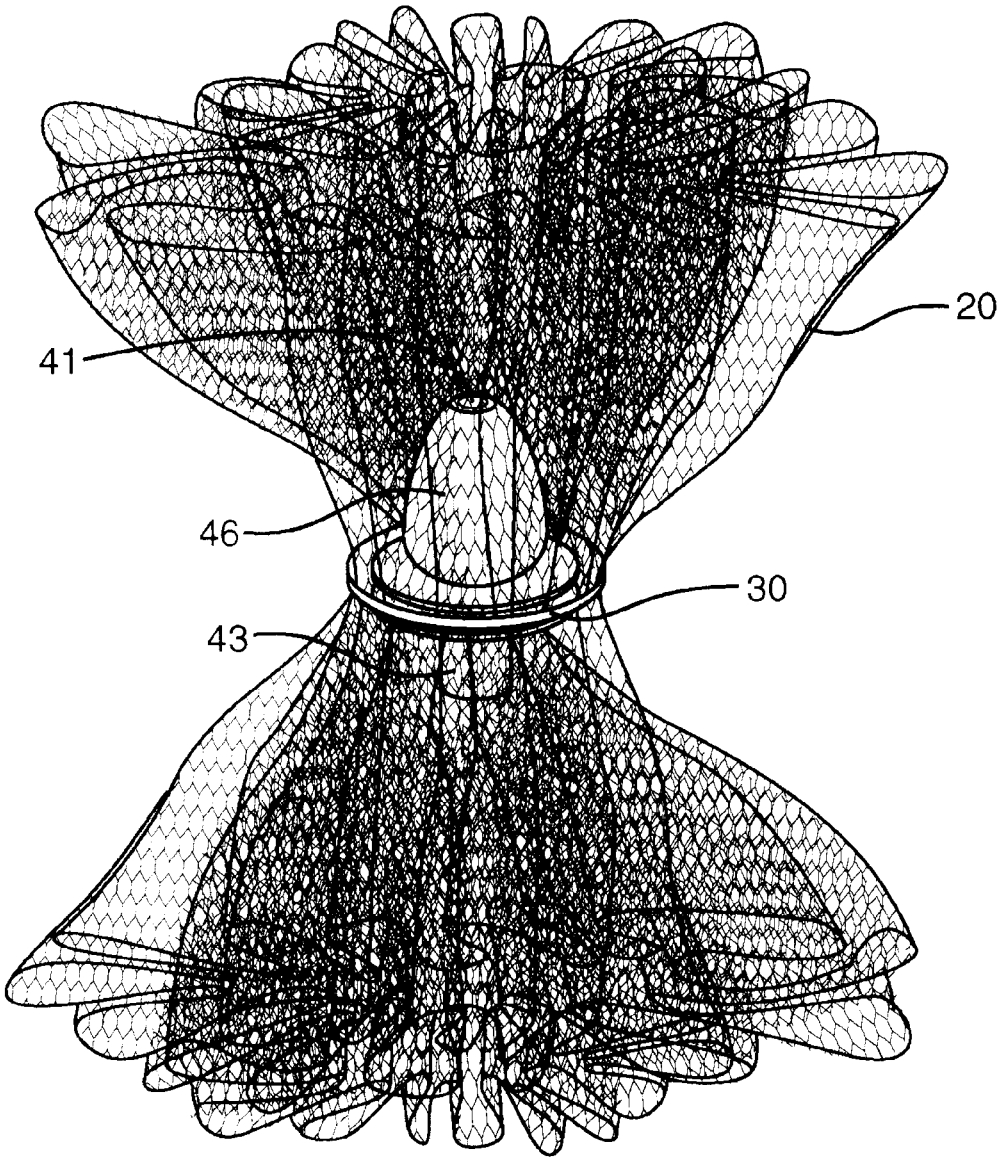
FIG. 5 is a perspective view illustrating the nozzle being secured by the cinch and being positioned within the material.

FIG. 5 illustrates the fluid dispenser embodiment being constructed. The material 20 is bundled together forming pleats and the cinch 30 is secured around a middle section of the pleats. The nozzle 46 is then inserted within the cinch 30 such that the outlet 41 extends on a first side of the cinch 30, and the neck 43 extends outward from a second side. The neck 43 extends outward such that the reservoir 48 may be attached. Neck 43 may be flared on the end to provide a secure seal. When the pleats are released, they fall to cover the cinch 30 and nozzle 46.

In preferred embodiments, the soap bar 42 and the fluid dispenser 44 are visibly obscured by the pleats. Additionally, in preferred embodiments, the user does not see nor directly touch the soap. This adds to the comfort of using the device 10, and also aids in the aesthetic appearance.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A device for cleaning comprising:

a) a member constructed from an elongated material gathered in the longitudinal direction to from a plurality of pleats;

b) a fluid dispenser positioned within said plurality of pleats, said fluid dispenser having a nozzle and a removable reservoir, said nozzle being positioned within said pleats; and c) a cinch extending around said plurality of pleats and said nozzle to secure said pleats and nozzle within said plurality of pleats.

2. The device of claim 1, wherein said material is a mesh.

3. The device of claim 1, wherein said reservoir comprises a deformable bulb.

4. The device of claim 1, wherein said plurality of pleats extend outward from said cinch a distance further than said nozzle.

* * * * *